US005981915A

United States Patent [19]

Head

[11] Patent Number: 5,981,915

[45] Date of Patent: Nov. 9, 1999

[54] METHODS AND APPARATUS FOR RESUMING OPERATION OF AN OVEN

[75] Inventor: Jesse Spalding Head, Louisville, Ky.

[73] Assignee: General Electric Company, Louisville, Ky.

[21] Appl. No.: 08/890,276

[22] Filed: Jul. 9, 1997

[51] Int. Cl.[6] ..... H05B 1/02

[52] U.S. Cl. ..... 219/492; 219/506; 219/720; 99/325

[58] Field of Search ..... 219/720, 506, 219/501, 497, 486, 508–510, 492, 493, 723; 99/325; 307/142

[56] References Cited

U.S. PATENT DOCUMENTS

| | | | |
|---|---|---|---|
| 4,425,490 | 1/1984 | Takeda et al. . | |
| 4,533,810 | 8/1985 | Harmon et al. . | |
| 4,572,935 | 2/1986 | Karino . | |
| 4,613,739 | 9/1986 | Richards . | |
| 4,713,528 | 12/1987 | Hirata . | |
| 4,725,948 | 2/1988 | Mierzwinski . | |
| 4,785,152 | 11/1988 | Hirata | 219/720 |
| 4,841,125 | 6/1989 | Edamura | 219/506 |
| 4,849,595 | 7/1989 | Fowler . | |
| 5,084,847 | 1/1992 | Song . | |
| 5,097,113 | 3/1992 | Aoyama . | |
| 5,357,087 | 10/1994 | Choi . | |
| 5,373,142 | 12/1994 | Ohshima et al. . | |

FOREIGN PATENT DOCUMENTS

| | | |
|---|---|---|
| 4-214124 | 5/1992 | Japan . |

*Primary Examiner*—Mark Paschall
*Attorney, Agent, or Firm*—H. Neil Houser

[57] ABSTRACT

Apparatus and methods for eliminating the need for an operator to make multiple key entries in order to resume cooking subsequent completion of an initial cooking cycle. In connection with an oven having an electronic controller, the controller is programmed to provide a resume feature which includes the steps of determining whether certain conditions are satisfied subsequent to completion of an initial cooking cycle, and if such conditions are satisfied, then enabling the operator to continue cooking at the same temperature as the immediately previous cooking cycle for a predetermined time period, e.g., 2 minutes.

27 Claims, 4 Drawing Sheets

METHODS AND APPARATUS FOR RESUMING OPERATION OF AN OVEN

FIELD OF THE INVENTION

The present invention relates to cooking ovens, and more specifically, to methods and apparatus for operating such ovens to resume baking subsequent to expiration of a previous baking operation.

BACKGROUND OF THE INVENTION

Most baking in combination microwave/convection ovens is performed using a method commonly referred to as "time baking". A time bake operating mode is a time controlled operating mode characterized by the application of convection or thermal heat to a food item for a fixed period of time selected by an operator. When the selected time expires, the application of heat automatically terminates. For bakery goods, for example, the time period input typically should be a minimum time period required to cook the food load to a desired doneness and color. Using the minimum time period assures that the food will be inspected by an operator before any significant overcooking.

Selecting the minimum time period for cooking creates a need for a "finishing touch" cooking time period of one or two minutes to achieve optimum doneness and browning. With a typical microwave/convection oven, the oven must be reprogrammed to cook for the one or two minute finishing touch time period. Such reprogramming after cooking has terminated may require the operator to look up the last temperature setting, and then make 7–8 key entries. Such reprogramming is an inconvenience for the operator.

It would be desirable to eliminate the requirement that the operator make numerous key entries for such finishing touch cooking time period. It also would be desirable to eliminate such key entry requirement without resulting in any substantial overcooking of food.

SUMMARY OF THE INVENTION

These and other objects may be attained by apparatus and methods for eliminating the need for an operator to make multiple key entries in order to resume cooking subsequent completion of an initial cooking cycle. In connection with an oven having a programmable controller, the controller is programmed to enable the operator to continue cooking at the same temperature as the immediately previous cooking cycle for a predetermined time period, e.g., 2 minutes, by simply selecting the previously selected cooking cycle and actuating the start key, provided certain conditions are satisfied when the subsequent selection is made.

More specifically, and in one embodiment, once an operator starts a time controlled operating or cooking cycle, the cook time is displayed on the oven display and the time is counted down. Once the cook time has elapsed, i.e., cook time equals zero, or if a clear command is received by the controller, the controller terminates the cooking cycle and the cooking elements are no longer energized. If additional cook time is required, the operator repeats the selection of the cooking cycle on the oven keypad. If the repeat selection is received by the controller within a predetermined elapsed time from the termination of the previous cooking cycle, and if an oven temperature difference (as sensed by temperature sensors in the oven cooking cavity) between the oven temperature at the time of termination of the previous cooking cycle and the oven temperature at the time the controller receives the repeat selection is less than a predetermined temperature, then a prompting message, e.g., "PRESS START TO RESUME OR ENTER OVEN TEMP" is displayed on display.

If the controller receives the start command within a predetermined time, e.g., ten seconds from the display of this message, then previous cooking cycle is resumed. When the cooking cycle resumes, a confirmation message, e.g., "RESUME—CONVECT BAKE XXX" is displayed for 2 seconds, where XXX is the oven set temperature for the previous cooking cycle. For example, if the last selected oven temperature setting was 400 degrees Fahrenheit, then the message "RESUME—CONVECT BAKE 400" would be displayed. This message informs the operator that the previously selected cooking cycle is continuing and reminds the user of the previously selected temperature.

After about two seconds have elapsed from display of the confirmation message, then a time message representing the predetermined duration of the additional cooking period, e.g., "2:00", is displayed and a time countdown from the displayed time is initiated. When the cook time equals zero, the cooking cycle is terminated. At this point, the operator can simply remove the food, or continue in the same operating mode, but at a different temperature and/or time duration, simply by entering a new desired oven temperature and cooking time, or once again resume the just-ended cooking cycle for an additional two minutes.

The above described apparatus and method eliminate the requirement that the operator make numerous key entries for finishing touch cooking. In addition, the apparatus and method eliminate such key entry requirement without resulting in any substantial overcooking of food.

DETAILED DESCRIPTION

Figure 1:
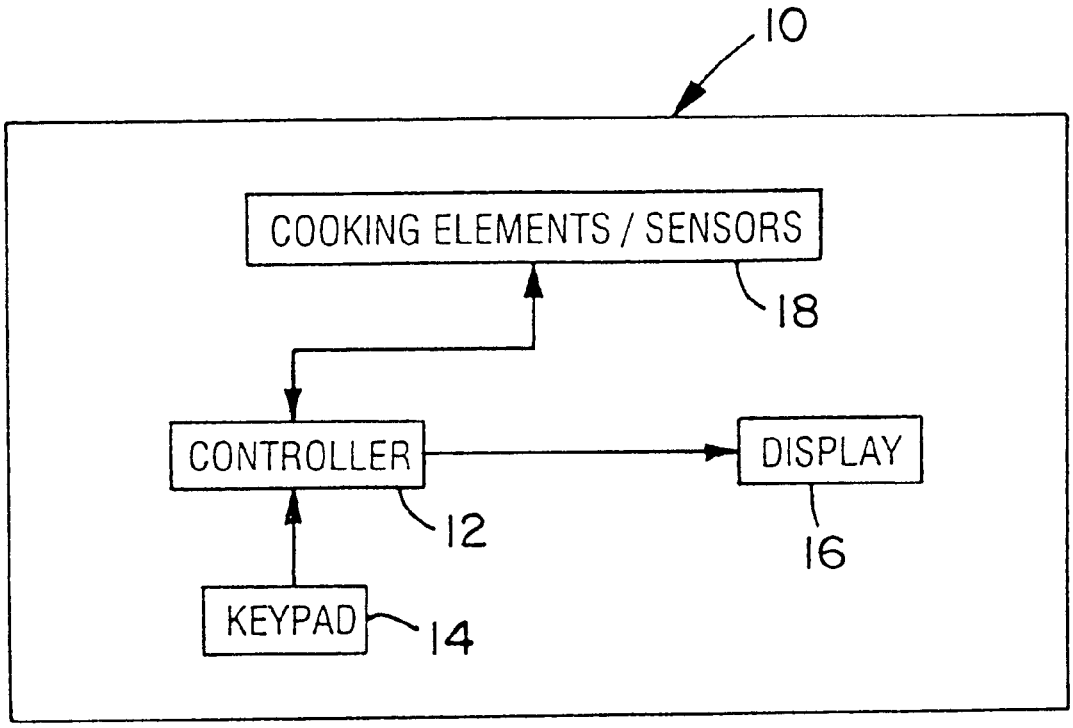
FIG. 1 is a block diagram of an oven.

FIG. 1 is a block diagram of an oven 10. Oven 10 may, for example, be a combination microwave/convection type oven of the type commercially available from General Electric Company, Louisville, Ky., 40225. Oven 10 includes a pre-programmed controller 12 coupled to a keypad 14 and a display 16. An operator may input instructions to controller 12 via keypad 14, and certain messages and data are displayed by controller 12 on display 16. For example, the remaining time in a cooking cycle may be displayed by controller 12 on display 16. Controller 12 also is coupled to cooking elements and sensors 18, e.g., temperature sensors, located in the oven cooking cavity. Instructions input by an operator at keypad 14 are utilized by controller 12 in controlling operation of cooking elements 18. Temperature signals representative of the oven temperature are provided to controller 12 by sensors 18 so that controller 12 can determine whether the desired operation is being achieved.

Oven 10 is illustrated herein as an exemplary combination microwave/convection oven and while the present invention may be advantageously applied in such ovens, it may be applicable to any type of baking oven featuring a time-bake operating mode. Such ovens may be modified to incorporate the resume cooking routine described below in more detail.

Figure 2:
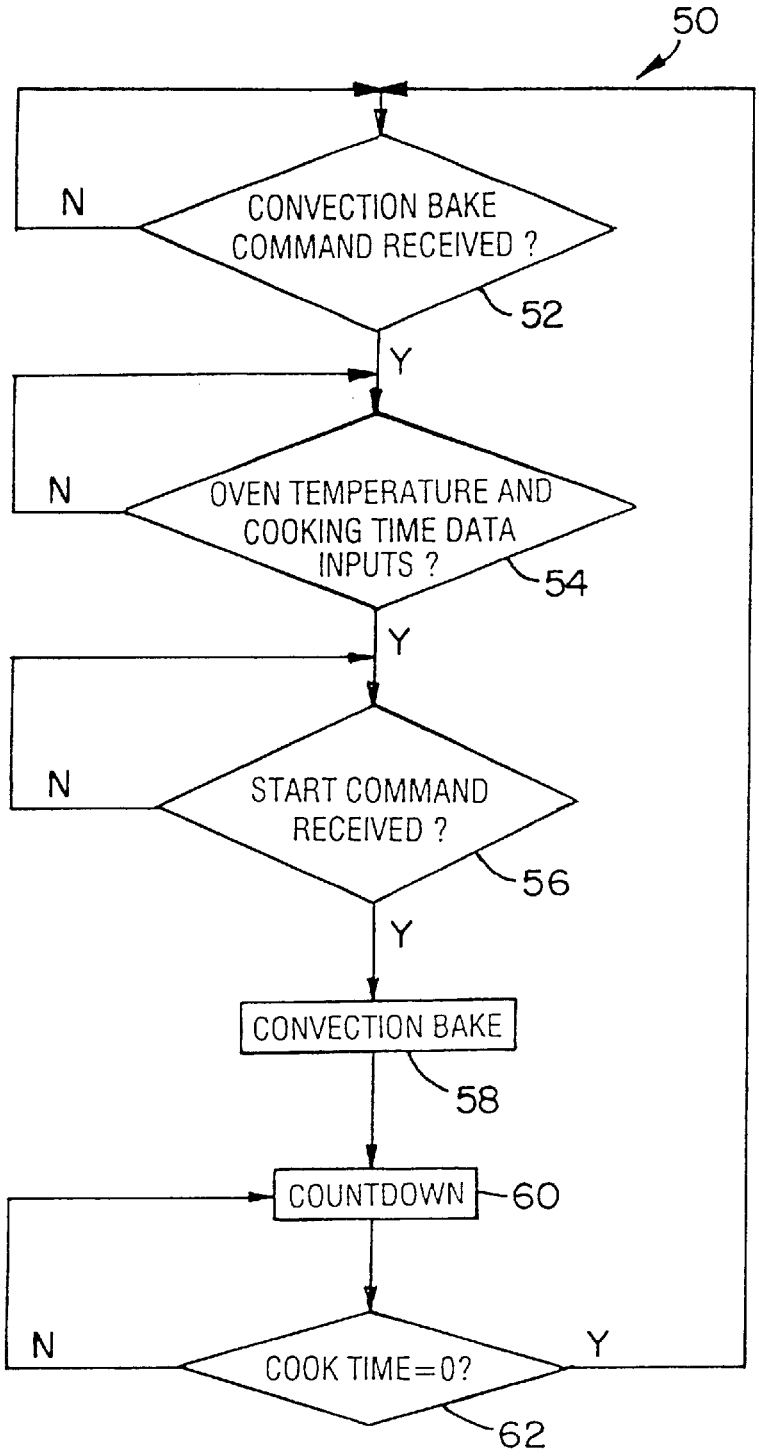
Fig. 2 Prior Art
FIG. 2 is a flow chart setting forth a known time baking process typically used in cooking food in known microwave and convection ovens.

FIG. 2 is a flow chart setting forth processing steps 50 executed by controller 12 and associated with implementing a time controlled convection bake cycle in known convection ovens, such as convection oven 10 illustrated in FIG. 1. To initiate the convection bake operating mode, the operator selects CONVECTION BAKE on keypad 14 and controller 12 receives a convection bake command 52. The operator then enters the desired oven temperature and cooking time on keypad 14, and the input temperature and cooking time are supplied as inputs 54 to controller 12. If controller 12 receives both the desired oven temperature and cooking time at step 54, then controller 12 waits to receive the start command 56. Once the operator then selects START on keypad 14 and controller 12 receives the start command 56, controller 12 initiates convection baking 58. Of course other conditions may be necessary in order to actually start cooking, e.g., the oven door may have to be closed.

Additionally, the controller may be programmed to provide a pre-heat operating mode. For example, to initiate the pre-heat mode, the operator inputs the desired oven temperature and simply selects START on keypad 14. Upon receipt of only the desired oven temperature and the start command, controller 12 causes oven to be pre-heated to the selected temperature and then returns to step 54 and waits for receipt of cooking time data.

Once convection baking is initiated 58, controller 12 causes the cook time to be displayed on display 16 and counts down the time 60. Such time count down is displayed to the operator on display 16. Once the cook time has elapsed 62, i.e., cook time equals zero, then controller 12 generates a time-out signal and disables cooking elements 18. Controller then wait to receive another convection bake command. Therefore, if additional cook time is required, the operator must once again select convection bake, enter the oven temperature and cooking time, and select START.

As explained above, the time period input typically should be a minimum time period required to cook the food load to a desired doneness and color. In using the minimum time period, however, it is very likely that at least after generation of the first time-out signal, additional cooking will be required, i.e., a "finishing touch" cooking time period of one or two minutes will be required to achieve optimum doneness and browning. Therefore, it is likely that additional cook time will be desired after completion of the minimum time period cooking cycle. Of course, in order to cook for such additional time, reprogramming is necessary. Reprogramming, i.e., once again selecting convection bake, entering the oven temperature and cooking time, and selecting START, may require the operator to look up the last temperature setting, and then make 7–8 key entries. Such reprogramming is an inconvenience for the operator.

In one aspect, the present invention is directed to apparatus and methods for eliminating the need for an operator to make multiple key entries in order to resume cooking subsequent to completion of an initial cooking cycle. Generally, and in an exemplary embodiment, a resume cooking routine includes the steps of determining whether certain conditions are satisfied subsequent to completion of the initial cooking cycle, and if such conditions are satisfied, the resume routine enables the operator to continue cooking at the same temperature as the immediately previous cooking cycle for a predetermined time period, e.g., 2 minutes.

The conditions to be satisfied are conditions selected to assure that the operating condition of the oven is compatible with a resumption of the recently terminated cooking cycle for a "finishing touch" cooking period. In particular, the conditions are selected to guard against enabling a resumption of the cooking cycle after the oven has cooled to the point that a resumption of the cooking cycle would not perform satisfactorily.

Figure 3:
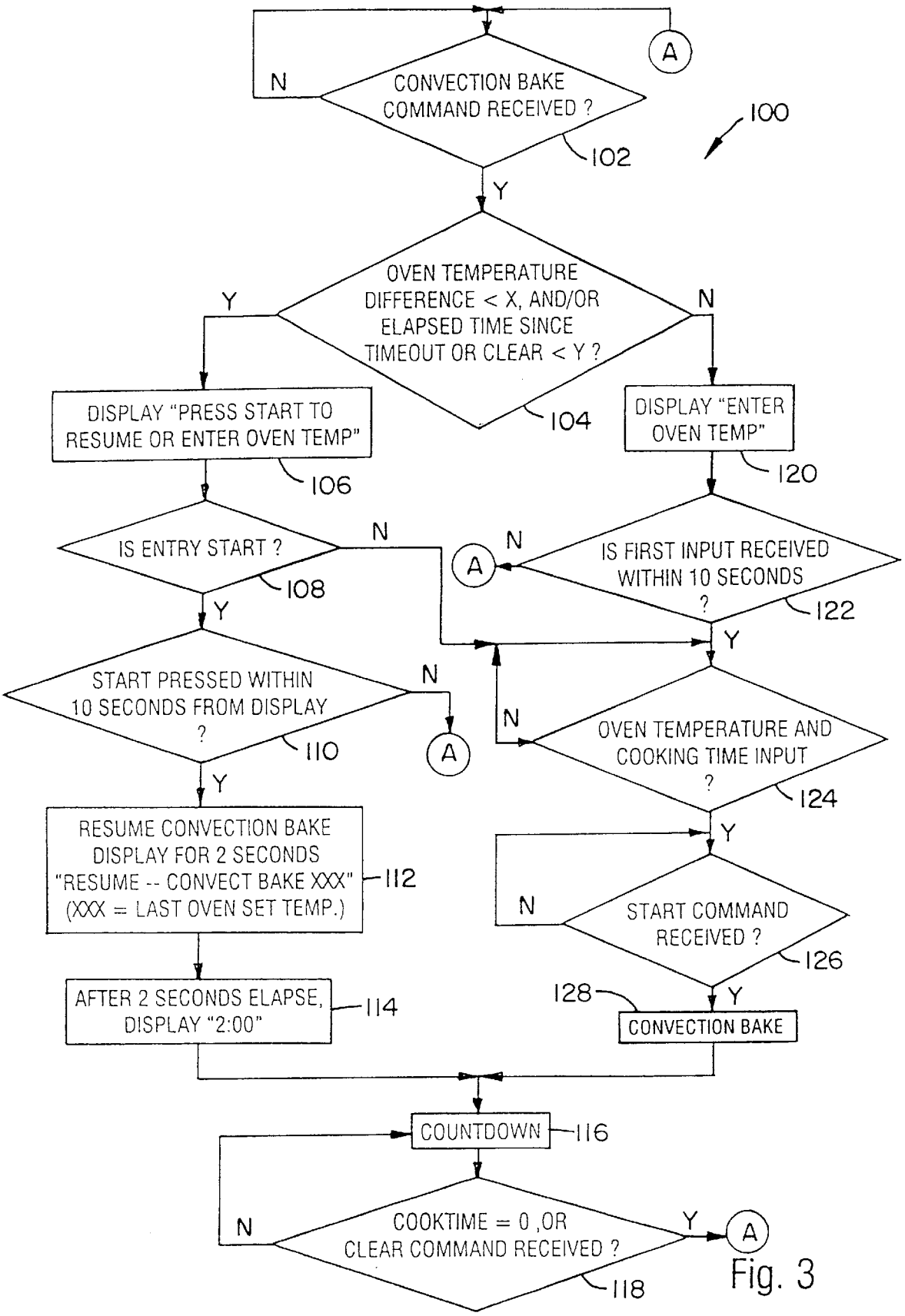
FIG. 3 illustrate steps for oven control in accordance with one embodiment of the present invention.

More specifically, and referring to FIG. 3 which illustrate steps 100 executed by controller 12 in accordance with one embodiment of the present invention, once controller 12 receives a convection bake command 102 from keypad 14, controller 12 then determines whether one or more certain operating conditions are satisfied. In particular, controller 12 determines whether the elapsed time since termination of the immediately preceding cooking cycle (resulting from timing out or the entry of a clear signal) is less than a predetermined time period Y 104, and/or whether the temperature difference between the oven temperature at the time of the termination of the immediately preceding cooking cycle, and the oven temperature at the time the new convection bake command is received, is less than a predetermined value, X.

As indicated above, both or only one of these conditions (i.e., oven temperature difference and/or elapsed time) may be used to determine whether the resume option is to be executed. In any event, if the required conditions are satisfied, then controller 12 displays 106 on display 16 the prompting message, "PRESS START TO RESUME OR ENTER OVEN TEMP". If start command is entered 108, and if the start command is received by controller 12 within a predetermined time, e.g., 10 seconds 110 from display of prompting message 106, then controller 12 causes oven 10 to resume convection baking 112. If the start command is not received within 10 seconds 110, the operations return to step 102.

With respect to resuming convection bake 112, the confirmation message "RESUME—CONVECT BAKE XXX" is displayed for 2 seconds, where XXX is the last oven set temperature. For example, if the last oven temperature setting was 400 degrees Fahrenheit, then the confirmation message "RESUME—CONVECT BAKE 400" would be displayed. From this message an operator can confirm whether the oven temperature is the desired temperature. After about two seconds have elapsed from display of message 112, then the time message "2:00" is displayed 114 and a time countdown from two minutes is initiated 116. When the cook time equals zero, or if a clear command is received 118 by controller 12, then processing returns to step 102. When the cook time equals zero, controller 12 generates a time-out signal.

If, at step 104, controller 12 determines that the operating conditions are not satisfied, e.g., the oven temperature difference is greater than or equal to X, and/or if the elapsed time since the timeout or clear is greater than or equal to Y, then the operator can no longer simply resume the previous convection bake cycle. However, the user can initiate a convection bake cycle by simply entering the desired temperature and time for the new cycle and pressing START. To this end, when the conditions are not satisfied, controller 12 causes the message "ENTER OVEN TEMP" to be displayed 120 on display 16. If an input is received within 10 seconds 122, then controller 12 waits to receive the oven temperature and cooking time inputs 124 from keypad 14. Once the oven temperature and cooking time are received, then controller 12 waits to receive the start command 126, and upon receipt of the start command, convection baking is initiated 128. A time countdown from the input time is then initiated 116, and when the cook time equals zero or if a clear command is received 118 by controller 12, then processing returns to step 102. If an input is not received by controller 12 within 10 seconds 122, then operations return to step 102.

Further, if at step 108 an entry other than a start command is entered and received by controller 12, then processing proceeds with controller 12 waiting to receive oven temperature and cooking time inputs 124. This logic provides a user with the option of initiating a new convection baking cycle at a different temperature and/or time, rather than resuming convection baking at the previously set temperature for two minutes.

Figure 4:
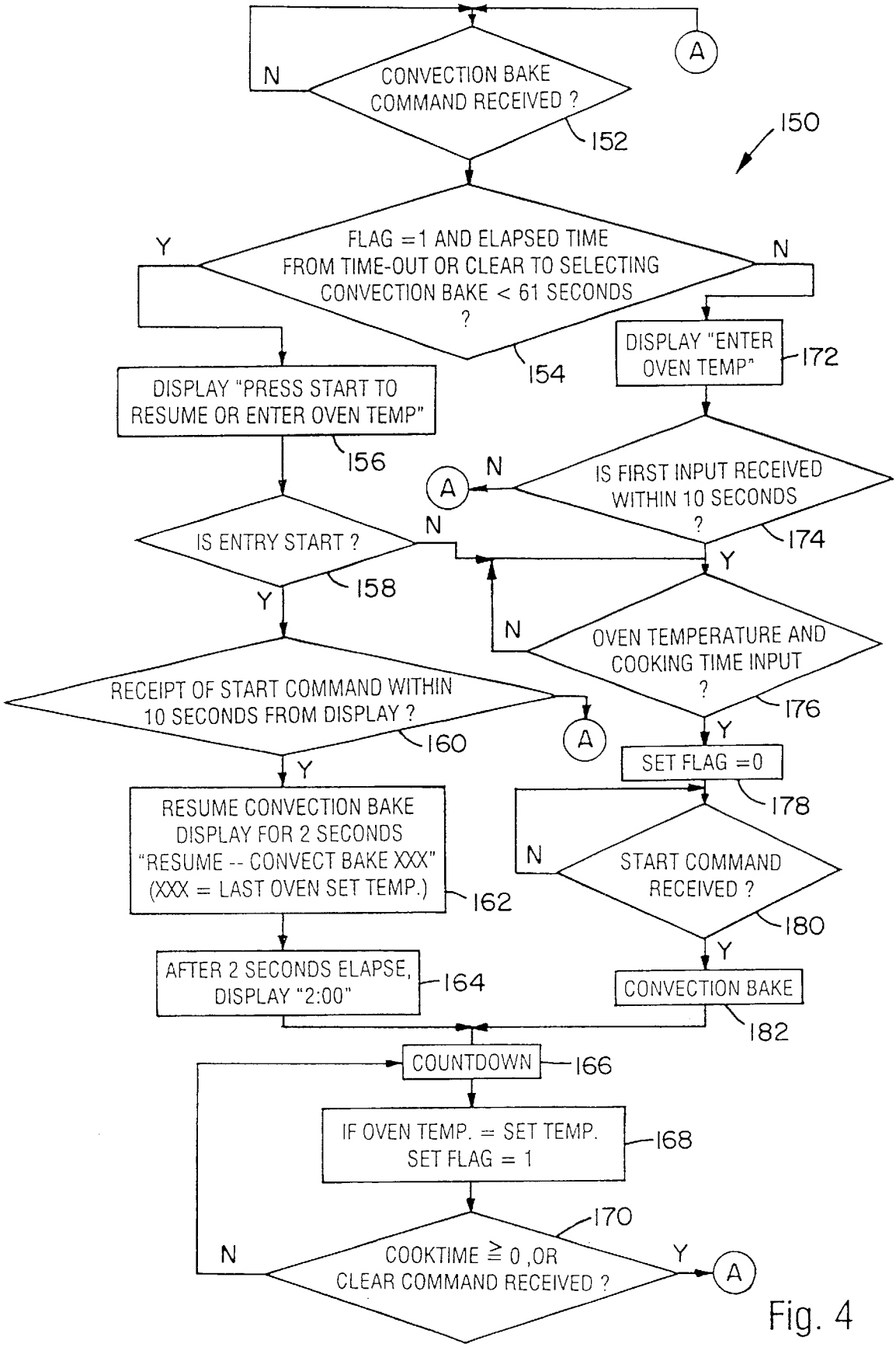
FIGS. 4 illustrate steps for oven control in accordance with another embodiment of the present invention.

FIG. 4 illustrates steps 150 executed by controller 12 in accordance with another embodiment of the present invention. In this embodiment the resume feature is enabled when the oven temperature during the just terminated cooking cycle at least reached the selected temperature and the time elapsed since termination is less than a predetermined value. The appropriate value for the elapsed time period may vary depending on the particular oven characteristics. The elapsed time period needs to be long enough to enable the operator to determine if further cooking is needed, yet short enough that the temperature conditions in the oven have not cooled to the point that a resumption of the just terminated cycle would not perform satisfactorily. In the oven of the illustrative embodiment, approximately one minute has been empirically determined to provide satisfactory performance.

In the embodiment of FIG. 4, a flag is used to inform the controller whether the oven temperature has reached the selected temperature. This flag is set to zero on power up and whenever a new temperature and time are entered, and is set to one when the newly selected temperature is first equaled or exceeded during the ensuing cooking cycle. Once set to one, it remains at one until a new set of time and temperature inputs are received.

Referring to the steps of FIG. 4, once controller 12 receives a convection bake command 152 from keypad 14, controller 12 then determines whether the predesignated flag is set to 1 and whether elapsed time since generation of the immediately preceding time-out signal or receipt of a clear command is less than 61 seconds 154. If both conditions are satisfied, then controller 12 displays 156 on display 16 the prompting message "PRESS START TO RESUME OR ENTER OVEN TEMP". If the start command is received 158 by controller 12, and if the start command is received by controller 12 within 10 seconds 160 from display of message 156, then controller 12 causes oven 10 to resume convection baking 162. If the start command is not received within 10 seconds 160, then operations return to step 152.

With respect to resuming convection bake 162, the confirmation message "RESUME—CONVECT BAKE XXX" is displayed for 2 seconds, where XXX is the last oven set temperature. For example, if the last oven temperature setting was 400 degrees Fahrenheit, then the message "RESUME—CONVECT BAKE 400" would be displayed. From this message an operator can confirm whether the oven temperature is the desired temperature. After about two seconds have elapsed from display of message 162, then the time message "2:00" is displayed 164 and a time countdown from two minutes is initiated 166. If the actual oven temperature equals or exceeds the set oven temperature during convection baking 168, then the flag is set to 1. When the cook time equals zero, or if a clear command is received by controller 170, then processing returns to step 152. When the cook time equals zero, controller 12 generates a time-out signal.

If, at step 154, controller 12 determines that the flag is set to one, and the elapsed time since the timeout or clear is greater than or equal to 61 seconds, the controller 12 causes the message "ENTER OVEN TEMP" to be displayed 172 on display 16. If an input is not received by controller 12 within 10 seconds 174, then operations return to step 152. If an input is received within 10 seconds, then controller 12 waits to receive the oven temperature and cooking time inputs 176 from keypad 14. Once the oven temperature and cooking time are received, then controller 12 sets the flag to zero 178 and waits to receive the start command 180. Upon receipt of the start command, convection baking is initiated 182. A time countdown from the input time is initiated 166, and when the cook time equals zero or if a clear command is received 170 by controller 12, then processing returns to step 152.

If at step 158 a command other than a start command is entered and received by controller 12, then processing proceeds to controller 12 waiting to receive oven temperature and cooking time inputs 176. This logic provides a user with the option of initiating a new convection baking cycle rather than resuming convection baking at the previously set temperature for two minutes.

The above described apparatus and methods eliminate the requirement that the operator make numerous key entries for a finishing touch cooking time period. In addition, the apparatus and methods eliminate such key entry requirement without resulting in any substantial overcooking of food.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

I claim:

1. A control arrangement for a cooking oven of the type having at least one operator selectable time controlled operating mode, said control arrangement comprising:

operator actuable input means for enabling the operator to select a time controlled operating mode and to select the desired time duration and operating temperature for such operating mode;

sensing means for sensing the operating temperature in the oven;

a controller responsive to said input means and said sensing means and operative to control the operation of the oven to implement an operating cycle in accordance with the selected operating mode, time and temperature, said controller being operative to terminate the operating cycle when the selected time expires;

said controller being further operative in response to the selection of said time controlled operating mode, to determine the elapsed time since the termination of the preceding operating cycle and the oven temperature, and if at least one predetermined operating condition relating to said elapsed time or said oven temperature, is satisfied, to continue the previously selected operating cycle for an additional predetermined period of time.

2. A control arrangement in accordance with claim 1 wherein a first predetermined operating condition is satisfied when said elapsed time is less than a predetermined time.

3. A control arrangement in accordance with claim 1 wherein a first predetermined condition is satisfied when the difference between said oven temperature and the selected temperature for the previously selected operating cycle is less than a predetermined value.

4. A control arrangement in accordance with claim 1 wherein at least two predetermined operating conditions relating to said elapsed time or said oven temperature, must be satisfied, to continue the previously selected operating cycle for an additional predetermined period of time, said first predetermined operating condition being satisfied when the difference between said oven temperature and the selected temperature for the previously selected operating cycle is less than a predetermined value and said second predetermined operating condition being satisfied when said elapsed time is less than a predetermined time.

5. A control arrangement in accordance with claim 1 wherein at least two predetermined operating conditions relating to said elapsed time or said oven temperature, must be satisfied, to continue the previously selected operating cycle for an additional predetermined period of time, said first predetermined operating condition being satisfied when the oven temperature during the previously selected operating cycle reached the selected temperature, and said second predetermined operating condition being satisfied when said elapsed time is less than a predetermined time.

6. A control arrangement in accordance with claim 3 further comprising display means and wherein said operator actuable input means further comprises means for enabling the user to input a start command, and said controller is further operative in response to the selection of said time controlled operating mode, if at least one predetermined operating condition relating to said elapsed time or said oven temperature, is satisfied, to cause said display means to generate a prompting message, said controller being operative in response to the inputting of a start command within a predetermined time of said display of said prompting message to continue the previously selected operating cycle for said additional predetermined period of time.

7. A control arrangement in accordance with claim 1 wherein said operator actuable input means further comprises means enabling the operator to input a clear command, and wherein said controller is operative in response to said clear command to terminate the operating cycle, said controller being further operative in response to the selection of said time controlled operating mode following the input of a clear command, to determine the elapsed time since the termination of the preceding operating cycle in response to a clear command and the oven temperature, and if at least one predetermined operating condition relating to said elapsed time or said oven temperature, is satisfied, to continue the previously selected operating cycle for an additional predetermined period of time.

8. A control arrangement in accordance with claim 7 wherein said time controlled operating mode is a convection bake mode.

9. A method for operating an oven, the oven including a keypad, a controller and a display, said method comprising the steps of:

displaying a remaining cook time during a cooking cycle;

generating a time-out signal when the remaining cook time equals zero; and subsequent to generation of the time-out signal, determining whether at least a first predetermined condition is satisfied and if at least the first predetermined condition is satisfied, then displaying a message instructing an operator how to resume cooking at a previously entered temperature for a preprogrammed time period.

10. A method in accordance with claim 9 wherein the first predetermined condition is that a first command is received by the controller within a predetermined elapsed time from generation of the time-out signal.

11. A method in accordance with claim 10 wherein the first command is the convection bake command.

12. A method in accordance with claim 11 wherein in addition to the first predetermined condition, a second predetermined condition must be satisfied prior to displaying the message instructing an operator how to resume cooking at a previously entered temperature for a preprogrammed time period.

13. A method in accordance with claim 12 wherein the second predetermined condition is that an oven temperature difference between the oven temperature at the time of generation of the time-out signal and the oven temperature at the time the controller receives the convection bake command is less than a predetermined temperature.

14. A method in accordance with claim 12 wherein the second predetermined condition is that the oven temperature must have reach a selected temperature prior to generation of the time-out signal.

15. An oven comprising a controller, and a keypad and a display coupled to said controller, said controller programmed to provide data to said display for display of a remaining cook time during a cooking cycle, generate a time-out signal when the remaining cook time equals zero, and subsequent to generation of the time-out signal, determine whether at least a first predetermined condition is satisfied and if at least the first predetermined condition is satisfied, then provide message data to said display for display of a message instructing an operator how to resume cooking at a previously entered temperature for a preprogrammed time period.

16. An oven in accordance with claim 15 wherein the first predetermined condition is that said controller receive a first command within a predetermined elapsed time from generation of the time-out signal.

17. An oven in accordance with claim 16 wherein said first command is a convection bake command.

18. An oven in accordance with claim 16 wherein in addition to the first predetermined condition, a second predetermined condition must be satisfied to display the message instructing an operator how to resume cooking at a previously entered temperature for a preprogrammed time period.

19. An oven in accordance with claim 18 wherein the second predetermined condition is that an oven temperature difference between the oven temperature at the time of generation of the time-out signal and the oven temperature at the time said controller receives the convection bake command is less than a predetermined temperature.

20. An oven in accordance with claim 18 wherein the second predetermined condition is that the oven temperature must have reach a selected temperature prior to generation of the time-out signal.

21. An oven comprising a controller, and a keypad and a display coupled to said controller, said controller programmed to respond to selection on said keypad of a time controlled operating mode, time, and temperature by implementing an operating cycle in accordance with the selected time controlled operating mode, time, and temperature, said controller further programmed to terminate the operating cycle when the selected time expires, and subsequent to termination of the operating cycle, if a time controlled operating mode selected on said keypad is the same operating mode as the operating mode for the immediately preceding terminated operating cycle, and if at least one predetermined condition is satisfied, then provide message data to said display for display of a message instructing an operator how to resume cooking at a previously entered temperature for a preprogrammed time period.

22. An oven in accordance with claim 21 wherein one of the selectable time controlled operating modes is convection bake.

23. An oven in accordance with claim 21 wherein said predetermined condition is satisfied when an elapsed time from termination of the previous operating cycle and subsequent selection of a time controlled operating mode is less than a predetermined time.

24. An oven in accordance with claim 21 wherein said predetermined condition is satisfied when the difference between the oven temperature and the selected oven temperature for the previously selected operating cycle is less than a predetermined value.

25. An oven in accordance with claim 21 wherein at least two predetermined conditions must be satisfied to provide message data to said display for display of a message instructing an operator how to resume cooking at a previously entered temperature for a preprogrammed time period, said first predetermined operating condition being satisfied when an elapsed time from termination of the previous operating cycle and subsequent selection of a time controlled operating mode is less than a predetermined time, and said second predetermined operating condition being satisfied when the difference between the oven temperature and the selected oven temperature for the previously selected operating cycle is less than a predetermined value.

26. An oven in accordance with claim 21 wherein at least two predetermined conditions must be satisfied to provide message data to said display for display of a message instructing an operator how to resume cooking at a previously entered temperature for a preprogrammed time period, said first predetermined operating condition being satisfied when an elapsed time from termination of the previous operating cycle and subsequent selection of a time controlled operating mode is less than a predetermined time, and said second predetermined operating condition being satisfied when the oven temperature during the previously selected operating cycle reached the selected temperature.

27. An oven in accordance with claim 21 wherein said predetermined condition is related to at least one of an elapsed time from termination of the previous operating cycle and an oven temperature.

* * * * *